US006371483B1

(12) United States Patent
Edmunds et al.

(10) Patent No.: US 6,371,483 B1
(45) **Date of Patent: *Apr. 16, 2002**

(54) GAME OF CHANCE

(76) Inventors: Scott Edmunds; Darin Willis, both of 103 N. Coast Highway, #250, Encinitas, CA (US) 92024

( * ) Notice: Subject to any disclaimer, the term of this patent is extended or adjusted under 35 U.S.C. 154(b) by 0 days.

This patent is subject to a terminal disclaimer.

(21) Appl. No.: 09/524,998

(22) Filed: Mar. 14, 2000

Related U.S. Application Data

(63) Continuation-in-part of application No. 09/133,057, filed on Aug. 11, 1998, now Pat. No. 6,036,190.
(60) Provisional application No. 60/055,573, filed on Aug. 11, 1997.

(51) Int. Cl.[7] ..... A63F 1/00
(52) U.S. Cl. ..... 273/292; 273/274; 273/302; 273/304
(58) Field of Search ..... 273/292, 274, 273/302, 304

(56) References Cited

U.S. PATENT DOCUMENTS 5,524,899 A * 6/1996 Hagedorn ..... 273/299
5,685,774 A * 11/1997 Webb ..... 463/13
5,743,530 A * 4/1998 Sklad et al. ..... 273/274
5,772,212 A * 6/1998 Hagedorn ..... 273/299
5,820,128 A * 10/1998 Brunelle ..... 273/292
6,036,190 A * 3/2000 Edmunds et al. ..... 273/292

* cited by examiner

*Primary Examiner*—Benjamin H. Layno
*Assistant Examiner*—Dolores R. Collins

(57) ABSTRACT

A game of chance uses a deck of playing cards which have imprinted thereon a variety of different symbols, such as the symbols that are used on reel strips in reel slot machines. Each player makes a first BET wager and the dealer deals three cards to each player. If the player receives a winning combination on the first three cards, the player proceeds to the draw step and receives a fourth card without having to make an additional wager in order to attempt to improve his hand. If the player does not have a winning combination on the first three cards, the player may optionally make a second DRAW wager and proceeds to the draw step and receives a fourth card in an attempt to improve his hand to a winning combination. The player does not have to discard at any time. The player then uses the best three or four cards after the draw step to make any possible winning combination as shown on a pay table. The player's highest hand is paid on the winning wager only. If the player achieves a winning combination in the DRAW step of the game, odds are paid on the DRAW wager only with the BET wager remaining as a "push", it is returned to the player. If the player does not improve his hand into a winning combination with the fourth card, both the BET wager and the DRAW wager are lost.

7 Claims, 3 Drawing Sheets

GAME OF CHANCE

CROSS-REFERENCE TO RELATED APPLICATION

This application is a Continuation-in-Part of application Ser. No. 09/133,057, filed Aug. 11, 1998, entitled Game of Chance", now U.S. Pat. No. 6,036,190 and is also based on and is a Continuation-in-Part of Provisional Application Ser. No. 60/055,573, filed Aug. 11, 1997.

This invention relates to a live table game of chance, and more particularly to a live table game of chance that incorporates certain gaming principles used in reel slot machines to create an exciting new game that is easy to understand for casino patrons of all skill levels.

BACKGROUND OF THE INVENTION

Live casino table games, such as Twenty-one, have been in gaming casinos for many years. One or more players are seated around a semi-circular gaming table and interact with a dealer during the conduct of the play of the game. Many players enjoy the camaraderie of engaging in gaming activity with other players such as occurs during the play of live casino table games. This is opposed to the solitary activity of playing a slot machine in which the player simply pulls the handle of the slot machine and is not able to interact with other players during the play of the slot machine. However, many players that are new to live table gaming are intimidated by games such as Twenty-One. While the basic method of play of Twenty-One is quite well known and relatively easy, most experts would agree that a player's chances of winning at Twenty-One are improved if the player plays his hands according to generally accepted Hit/Stay procedures. Novice Twenty-One players and many even more experienced players are not always well versed in these Hit/Stay procedures and often misplay their Twenty-one hands. Because the other players seated at the Twenty-One table can observe how each player plays his hand, it is apparent when a player makes a misplay.

Thus novice players and other players who are uncomfortable with their ability to play Twenty-One often shun this type of live table game. Rather than risk embarrassment that they might incur from misplaying their hand, they rather simply do not participate and either do not engage in gaming at all or enjoy other forms of gaming such as electronic or video games or reel slot machines. Other live table games, such as Craps, can also be intimidating to novice and less experienced players who are afraid to be observed in a multi-player setting improperly playing the game.

The basic appeal of slot machines is that there is no player skill involved. The player inserts one or more coins or gaming tokens, pulls the handle and the machine does the rest. The reels spin and the gaming symbols on the reel strips are displayed on the pay line. If a winning combination of symbols lines up on the pay line, the player wins. Thus the player of any experience level is not intimidated when playing a slot machine because his only decision is how many coins or tokens to wager and he cannot make a mistake in how the game is to be played. What is missing from slot machines, however, is the interaction with other players during the play of the game. The player has no one to share his joy of winning a payout and no one to commiserate with when the player loses.

Another drawback to conventional slot machines is that the player is limited to the amount that he can wager on any particular pull of the handle. Most slot machines are set at a fixed denomination—such as 5¢, 25¢, 50¢ or $1 (and up in more upscale gaming establishments). Depending on the type of slot machine, the player can wager one or more units of denomination on any given pull of the handle. However, if the player gets on a winning streak, the player cannot increase the denomination that he is playing (such as going from 25¢ to $1) without changing slot machines. Likewise, if the player is losing, he cannot lower the denomination that he is playing without changing slot machines (which the player may not wish to do since many slot players feel that a slot machine may be "due" for a jackpot if one has not appeared for some time).

It is an object of the present invention to provide a live table game of chance which allows the player to enjoy the camaraderie of playing with other players while at the same time being a straightforward and easily understandable game so that even the novice player is not intimidated and is less worried that he might misplay his hand.

It is a feature of the present invention to provide a live table game of chance in which the player makes an initial wager and is dealt an initial hand of three cards upon which are printed the symbols conventionally found on slot machine reels. If the player receives a winning combination on the first three cards (such as three matching symbols or one or two Cherries or a Wild symbol), the player receives a fourth card without having to make an additional wager in order to attempt to improve his hand. If the player does not have a winning combination on the first three cards, the player may make a second DRAW wager and proceeds to the draw step and receives a fourth card in an attempt to improve his hand. If the player improves his hand to a winning hand on the fourth card, the player receives an odds payout based on the amount of the player's second DRAW wager and the first BET wager is a "push." If the player does not improve his hand to a winning combination with the fourth card, the player would have lost both this BET wager and his DRAW wager. The player does not have to discard at any time. A player then uses the best three or four cards after the draw step to make any possible winning combination as shown on a pay table. Because of the live table game format used in the present invention, a player may change the amount of his wager from hand to hand and thus increase his wager when he is winning and decrease his wager when he is losing.

It is an advantage of the present invention that any player of any skill or experience level can engage in a live table game of chance and thereby enjoy associating with other players during the play of the game without having to fear being embarrassed or intimidated because his skill level is not sufficient to avoid making mistakes during the play of the hand.

Other objects, features and advantages of the present invention will become apparent from a consideration of the following detailed description.

SUMMARY OF THE INVENTION

A deck of playing cards is provided which have imprinted thereon a variety of different symbols, such as the symbols that are used on reel strips in reel slot machines (e.g. 7's, Bars, Bells, Grapes, Oranges, Melons and Cherries, and optionally a Wild Card symbol or symbols). Each player is playing against a pay table and not against the dealer or the other players. Each player makes a first BET wager and the dealer deals three cards to each player. If the player receives a winning combination on the first three cards; such as three matching symbols or one or two Cherries or a Wild symbol; the player proceeds to the draw step and receives a fourth card without having to make an additional wager in order to attempt to improve his hand. If the player does not have a winning combination on the first three cards, the player may make a second DRAW wager and proceeds to the draw step and receives a fourth card in an attempt to improve his hand. If the player improves his hand to a winning hand on the fourth card, the player receives an odds payout based on the amount of the player's second DRAW wager and the first BET wager is a "push." If the player does not improve his hand to a winning combination with the fourth card, the player would have lost both this BET wager and his DRAW wager. The player does not have to discard at any time. A player then uses the best three or four cards after the draw step to make any possible winning combination as shown on a pay table.

The amount won by the player is based on the pay table. The payouts shown in the pay table are based on a wager of one unit and are multiplied by the amount wagered by the player for wagers of more than one unit.

DETAILED DESCRIPTION OF THE PREFERRED EMBODIMENTS

The method of the present invention is played on a conventional gaming table 10 suitable for use with other live games, such as the type of gaming table that is used in the play of Twenty-one. The table is generally semicircular in shape with six or seven player positions 20 provided around the circumference of the semicircle. A dealer station is provided along the diameter of the semicircle and a conventional chip rack 30 is provided adjacent the dealer station. The table layout may contain one or more imprinted locations 40 that display to the player the pay table that is used in the method of play of the present invention.

Figure 1:
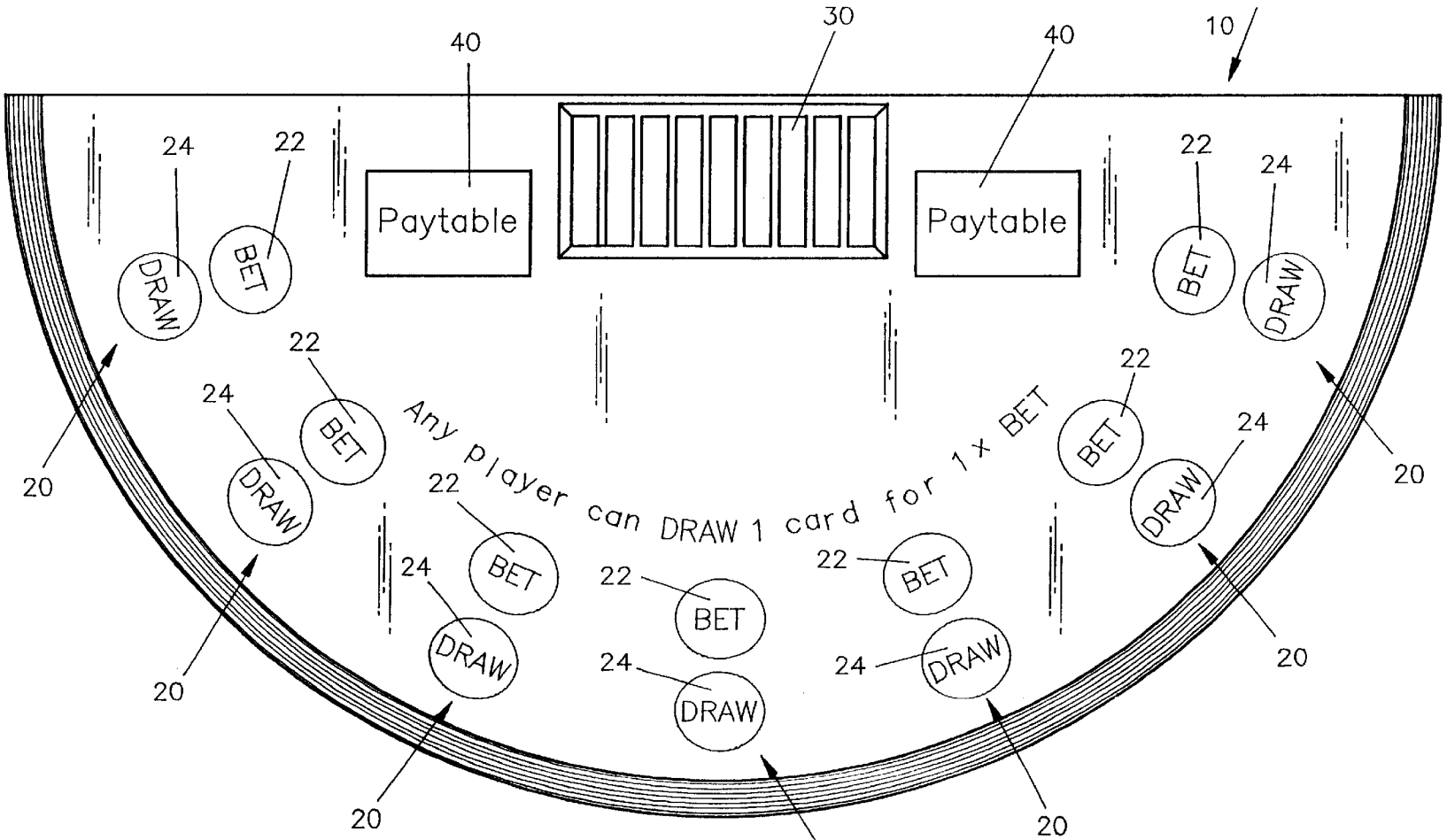
FIG. 1 shows a table layout used on a live gaming table to practice the method of the present invention.

As shown in FIG. 1, a table felt is provided on the top of the gaming table 10 having imprinted thereon symbols representing the player positions 20 and other basic information about the method of play of the present invention. Each player position is provided with two betting locations. The first location is for the initial wager, the "BET" wager 22. The second location is for the second wager, the "DRAW" wager 24.

Figure 2:
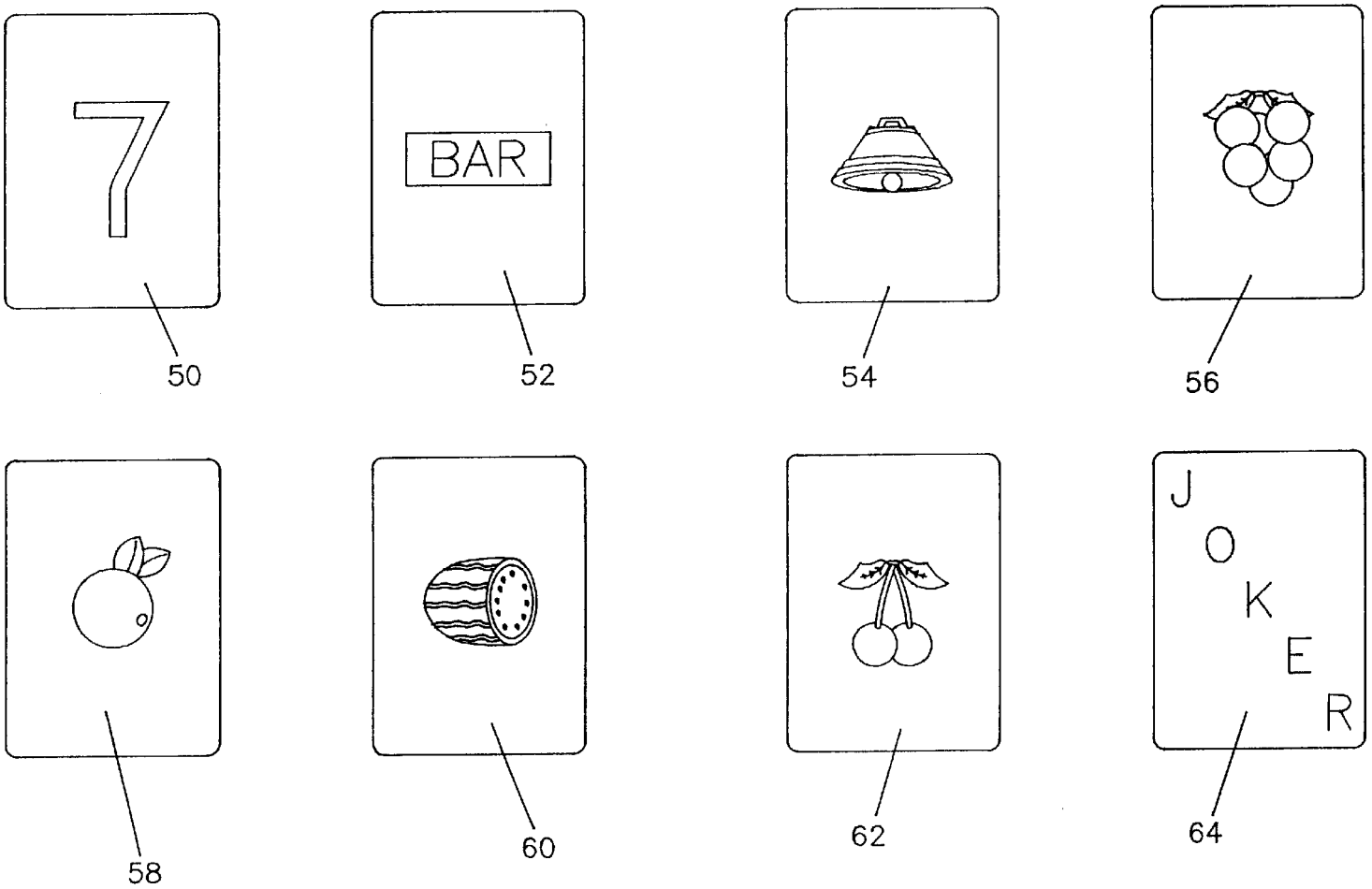
FIG. 2 shows the cards used in the present invention with the representative fruit symbols thereon.

The method of play of the present invention uses a deck of playing cards having the symbols that are used on reel strips in reel slot machines (such as 7's, Bars, Bells, Grapes, Oranges, Melons, Cherries and optionally Wild symbols). As shown in FIG. 2, the cards are printed with these symbols in any suitable configuration: "7" 50, "Bar" 52, "Bell" 54, "Grape" 56, "Orange" 58, "Melon" 60, "Cherry" 62 and "Joker" 64. Any suitable symbols can be used since the object of the game is to achieve three or four matching symbols or other pre-selected winning combinations such as one Cherry or two Cherries. In the preferred embodiment of the present invention, conventional slot machine fruit symbols are used to aid in the game being familiar to even the most casual casino patron.

The deck of playing cards comprises a suitable number of cards so that a mathematically suitable pool of elements is present. In the most preferred embodiment of the present invention, the deck of cards consists of fifty-three cards, although a lesser or greater number can be used.

The number and type of symbols used is also based on mathematical considerations. In the most preferred embodiment of the present invention, eight different symbols are used—7's, Bars, Bells, Grapes, Oranges, Melons and Cherries and a Wild Joker symbol (which acts as wild card and substitutes for any other symbol as may be needed to make a winning combination). The distribution of these symbols throughout the most preferred fifty-three card deck is three 7's, five Bars, eight Bells, ten Grapes, twelve Oranges, nine Melons, five Cherries and one Wild Joker. A greater or lesser number of symbols can be used and the use of one or more Wild Jokers is also optional. The amount of each type of symbol in the deck of cards can also be varied depending on the payout percentage desired.

In the preferred embodiment of the present invention, the player makes a 1st BET wager to be eligible to play the game. The player has the option of making a second DRAW wager to receive a fourth card during the optional draw step if the player's initial hand of three cards qualifies the player to proceed to the draw step. The qualification is "any pair or three-of-a-kind" to enter the DRAW round.

Each player is playing against a pay table and not against the dealer or the other players. The dealer deals three cards to each player. If the player is dealt three matching symbols, or One or Two Cherries or a Wild symbol, the player achieves a winning combination and is eligible to receive a payout based on the amount of the player's wager. The player may collect his winning amount and end the hand or the player may decline the winning amount, surrender his wager, make a second wager and proceed to the draw step of the method of play. When the player decides to DRAW, the player transfers any win due him to the DRAW round and the house or banker retains all BET wagers.

If the player is dealt two matching symbols of Oranges, Grapes, Melons, Bells, Bars or 7's, the player has the option of proceeding to the draw step or simply folding his hand and losing his first BET wager. If the player chooses to proceed to the draw step, the player loses his first BET wager and makes a second wager for the draw step.

If the player proceeds to the draw step, the player is dealt a fourth card. The player does not have to discard at any time. A player then uses the best three or four cards after the draw step to make any possible winning combination.

The amount won by the player is based on a pay table. A suitable pay table for use with the present invention is shown in Table 1. The payouts shown in the pay table are based on a wager of one unit and are multiplied by the amount wagered by the player for wagers of more than one unit.

TABLE 1

| PAY TABLE | | | | | JACKPOT |
|---|---|---|---|---|---|
| Best of 3 or 4 Cards | | | Pays to 1 | | DRAW! |
| CHERRY | **** | **** | 1 | | |
| CHERRY | CHERRY | **** | 2 | 4th card | 4 of a Kind |
| ORANGE | ORANGE | ORANGE | 4 | ORANGE | 9 |
| GRAPE | GRAPE | GRAPE | 5 | GRAPE | 11 |
| MELON | MELON | MELON | 6 | MELON | 14 |
| CHERRY | CHERRY | CHERRY | 7 | CHERRY | 17 |
| BELL | BELL | BELL | 7 | BELL | 17 |
| BAR | BAR | BAR | 20 | BAR | 50 |
| "7" | "7" | "7" | 40 | "7" | 400 |

Any suitable pay table can be used depending on the possible winning combinations, the number of cards in the deck, the number of symbols used, the distribution of the symbols throughout the deck of cards and the percentage of the amounts wagered which is mathematically desired to be retained by the gaming establishment.

For example, Table 2 shows a more generic pay table in which the fruit symbols are replaced by any suitable symbols that are represented in this pay table by simply letters of the alphabet.

TABLE 2

| PAY TABLE | | | | | JACKPOT |
|---|---|---|---|---|---|
| Best of 3 or 4 Cards | | | Pays to 1 | | DRAW! |
| A | **** | **** | 1 | | |
| A | A | **** | 2 | 4th card | 4 of a Kind |
| B | B | B | 4 | B | 9 |
| C | C | C | 5 | C | 11 |
| D | D | D | 6 | D | 14 |
| A | A | A | 7 | A | 17 |
| E | E | E | 7 | E | 17 |
| F | F | F | 20 | F | 50 |
| G | G | G | 40 | G | 400 |

The payout amounts shown in Table 2 can also be increased or decreased as desired based on the mathematics of the game and the desired theoretical percentages for player and the house.

The method of play of the present invention proceeds as follows. One or more players take positions around the gaming table layout. The dealer shuffles the deck of cards and each player makes a first BET wager in the wagering location provided in front of each player. The dealer proceeds to deal three cards to each player in any suitable manner, such as one card at a time to each player beginning from the dealer's left and proceeding around the table layout. In the preferred embodiment, each card is dealt face up so that the dealer and each player can see all of the cards in play.

If on the initial deal of the three cards the player receives a predetermined winning hand combination, the player can be paid the odds for such winning hand shown in the pay table times the amount of the player's BET wager. In the most preferred embodiment of the present invention, the winning hand combinations are three symbols of the same kind or one Cherry or two Cherries or a Joker. Note that the Joker card acts as a wild card and can be used as any symbol (including a Cherry) to achieve a winning combination. If a winning hand is also qualified to proceed to the optional draw step, the winning hand is not paid on this first "BET" wager, but is later paid during the optional draw step if that player decides to draw.

If the player does not have a winning hand combination on the initial deal, the player loses his BET wager. The player, however, may have the option to draw a fourth card if the player has a potentially winning hand on the initial deal of at least two of a kind (i.e. two matching symbols).

If the player has an initial hand of two or three matching symbols, the player can go on to the draw round by making a DRAW wager in the amount equal to the player's initial BET wager. In the draw round, the initial BET wager is lost to the house and the only wager at stake is the amount of the DRAW wager.

If the player makes a DRAW wager, the player is then dealt a fourth card. All four cards held by the player are then used to determine if the player has achieved one of the predetermined winning card combinations. Any and all winning hands are then paid according to the pay table.

Example #1: the player makes an initial BET wager of $10. The player is dealt 2 Oranges and 1 Bell. Since the player has 2 Oranges, he may exercise the option of entering the draw round of the game. The player loses his first BET wager of $10 to the house, but the player may make a DRAW wager of $10 because the player has an initial hand at least a pair of matching symbols which qualifies the player to go to the draw step of the method of play. If the player makes this DRAW wager of $10, the player then receives a fourth card and the player wins if any of his four cards form a winning combination. For example, if the player receives as his fourth card another Orange (or a Wild Joker), the player would have Three Oranges and would be paid 4 to 1 odds on his $10 DRAW wager which results in the player receiving $50 gross. If the player receives a Cherry as his fourth card, the player would be paid 1 to 1 odds on his $10 DRAW wager which results in the player receiving $20 gross.

Example #2: the player makes an initial BET wager of $5. The player is dealt 1 Joker, 1 Orange and 1 Bell. Since the Joker can be any symbol, the player has "any pair" and is qualified to proceed to the draw step if the player so desires. If the player opts to enter the draw round, the player makes a $5 wager at the draw location 24 in front of the player's location 20. If the player opts to enter the draw round, the player surrenders his $5 BET wager and any win amount that the player would have been entitled on his first three cards.

Now assume the player receives an Orange as the fourth card. The Joker being a wild card, the player's final hand is Three Oranges (only the highest symbol combination is paid) and would be paid 4 to 1 odds on his $5 DRAW wager which results in the player receiving $25 gross.

Example #3: the player makes an initial BET wager of $5. The player is dealt Three Melons. The player has at least "any pair or three-of-a-kind" and is qualified to proceed to the draw step if the player so desires. If the player declines to enter the draw round, the player is paid 6 to 1 odds on his $5 BET wager and receives $35 gross.

If the player opts to enter the draw round, the player makes a $5 wager at the draw location 24 in front of the player's location 20. If the player opts to enter the draw round, the player surrenders his $5 BET wager and any win amount that the player would have been entitled on his first three cards.

Now assume the player receives another Melon as the fourth card. The player's final hand is now Four Melons (only the highest symbol combination is paid) and would be paid 14 to 1 odds on his $5 DRAW wager which results in the player receiving $75 gross.

If the player did not receive a fourth Melon or a Joker as his fourth card, the player would be paid 6 to 1 odds for his final hand of Three Melons which results in the player receiving $35 gross on the DRAW wager only.

The mathematics of the pay table creates certain wagering combinations for the player. If the player has two matching symbols of any potentially winning combination and a Cherry (e.g. 2 Melons and a Cherry), the player has two options, both of which are interesting to the player.

1. The player can elect not to enter the draw round and automatically receive 1 to 1 odds on the amount of his BET wager.

2. The player can elect to enter the draw round by wagering as his DRAW wager the equal amount of his BET wager and receive, in effect, a free draw in an attempt to achieve a higher winning hand. Regardless of the outcome of the fourth card, the player will at worst receive 1 to 1 odds for the single Cherry; however, the result if the draw is missed is a push, compared to a one bet unit win in the first example.

In order to protect the player from trying to improve a "dead hand" (one that cannot be improved by the draw of a fourth card), the method of play only allows the player to enter the draw round if the player has any pair or three-of-a-kind of matching symbols in his initial three cards.

Figure 3:
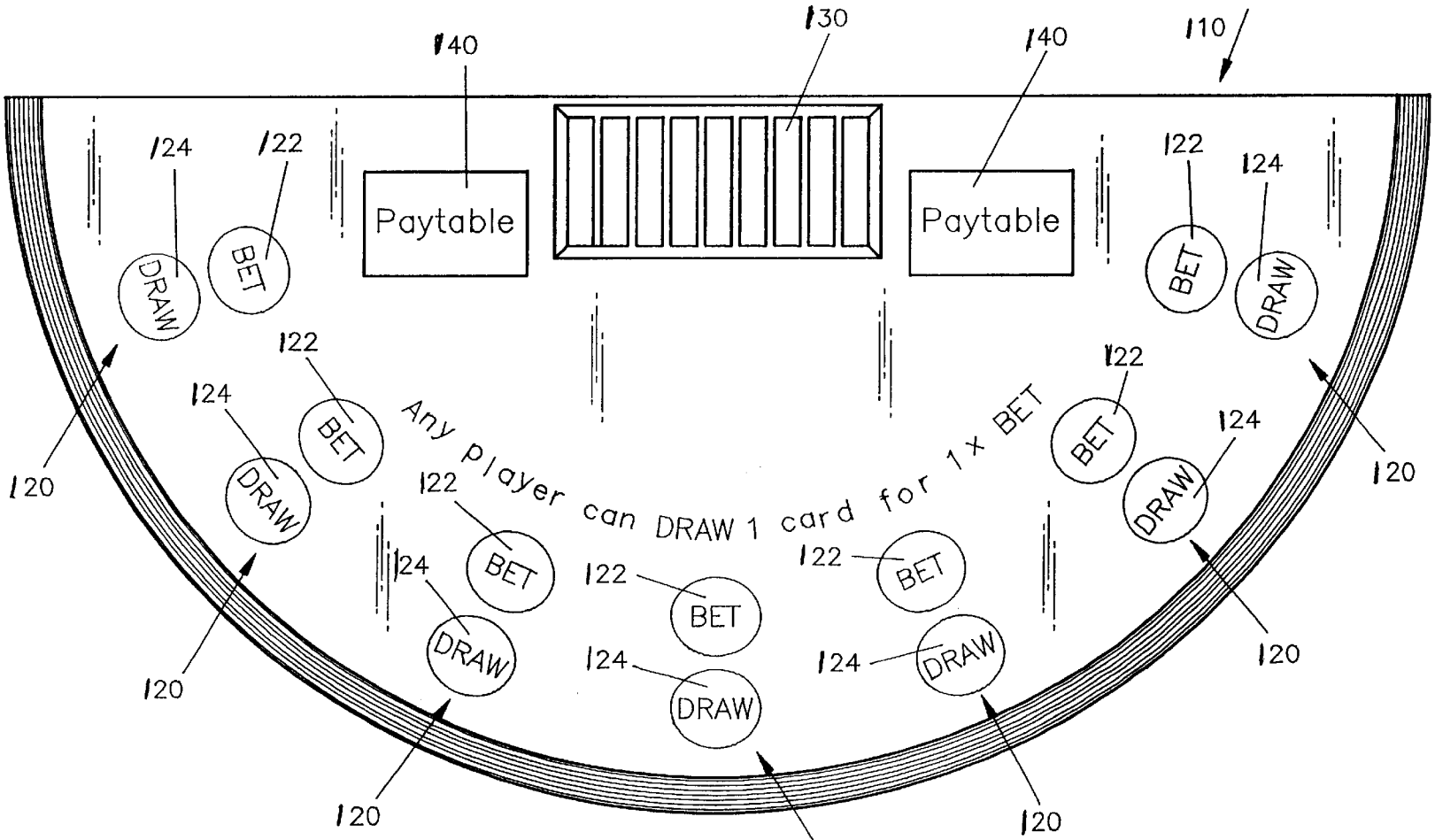
FIG. 3 shows a table layout used on a live gaming table to practice the alternative method of the present invention.

An alternative embodiment of the method of play of the present invention is shown in FIG. 3. This method of play is also played on a conventional gaming table 110 with six or seven player positions 120 provided around the circumference of the gaming table. A conventional chip rack 130 is provided adjacent the dealer station and the table layout may contain one or more imprinted locations 140 that display to the player the pay table that is used in the method of play of the present invention.

As shown in FIG. 3, the top of the gaming table has imprinted thereon symbols representing the player positions 120 and each player position is provided with two betting locations. The first location is for the initial wager, the "BET" wager 122. The second location is for the second wager, the "DRAW" wager 124.

The method of play of this embodiment of the present invention also uses a deck of playing cards having the symbols that are used on reel strips in reel slot machines (such as 7's, Bars, Bells, Grapes, Oranges, Melons, Cherries and optionally Wild symbols). Any suitable symbols can be used since the object of the game is to achieve three or four matching symbols or other pre-selected winning combinations such as one Cherry, two Cherries, or a Wild symbol. In the preferred embodiment of the present invention, conventional slot machine fruit symbols are used to aid in the game being familiar to even the most casual casino patron.

The deck of playing cards comprises a suitable number of cards so that a mathematically suitable pool of elements is present. In the most preferred embodiment of this alternative version of the present invention, the deck of cards consists of fifty-three cards, although a lesser or greater number can be used.

The number and type of symbols used is also based on mathematical considerations. In the most preferred embodiment of the present invention, eight different symbols are used—7's, Bars, Bells, Grapes, Oranges, Melons and Cherries and a Wild Joker symbol (which acts as wild card and substitutes for any other symbol as may be needed to make a winning combination). The distribution of these symbols throughout the most preferred fifty-three card deck is: three 7's, fifteen Bars, eight Bells, ten Grapes, twelve Oranges, nine Melons, five Cherries and one Wild Joker. A greater or lesser number of symbols can be used and the use of one or more Wild Jokers is also optional. The amount of each type of symbol in the deck of cards can also be varied depending on the payout percentage desired.

In the preferred embodiment of this alternative variation of the present invention, the player makes a wager in the respective BET wager location 122 to be eligible to play the game. Then three cards are dealt to each eligible player. Each player is playing against a pay table and not against the dealer or the other players.

If the player receives a winning combination on the first three cards (such as three matching symbols, one or two Cherries, or a Wild symbol), the player proceeds to the draw step and receives a fourth card without having to make an additional wager in order to attempt to improve his hand. In the preferred embodiment of this alternative variation on the present invention, the player is then dealt a fourth card and the outcome of the player's final hand is determined. The player does not have to discard at any time. A player then uses the best three or four cards after the draw step to make any possible winning combination as shown on a pay table.

The amount won by the player is based on the pay table. The payouts shown in the pay table are based on a wager of one unit and are multiplied by the amount wagered by the player for wagers of more than one unit. Order or position of cards does not matter, except for an optional Sequential Jackpot Award.

If the player does not have a winning combination on the first three cards, the player may make a second DRAW wager and proceed to the draw step and receives a fourth card in an attempt to improve his hand. The second wager made by the player is placed in the DRAW wager location 124, and is preferably equal in amount to the player's first wager. Again, the player does not have to discard at any time. The player uses the best three or four cards after the draw step to make any possible winning combination as shown on a pay table. The player should take this option when the hand he has contains a pair and he can improve his hand to a three of a kind.

If the player improves his hand to a winning combination with the fourth card, then the player receives an odds payout based on the amount of the DRAW wager and the BET wager is a "push." If the player does not improve his hand to a winning combination with the fourth card, then the player loses both the DRAW wager and the BET wager.

The amount won by the player is based on a pay table. A suitable pay table for use with this alternative version of the present invention is shown in Table 3. The payouts shown in the pay table are based on a wager of one unit and are multiplied by the amount wagered by the player for wagers of more than one unit.

TABLE 3

| PAY TABLE | | | | | JACKPOT |
|---|---|---|---|---|---|
| Best of 3 or 4 Cards | | | Pays to 1 | | DRAW! |
| CHERRY | **** | **** | ½ | | |
| CHERRY | CHERRY | **** | 2 | 4th card | 4 of a Kind |
| ORANGE | ORANGE | ORANGE | 3 | ORANGE | 7 |
| GRAPE | GRAPE | GRAPE | 4 | GRAPE | 10 |
| MELON | MELON | MELON | 5 | MELON | 12 |
| BELL | BELL | BELL | 6 | BELL | 15 |
| CHERRY | CHERRY | CHERRY | 7 | CHERRY | 25 |
| BAR | BAR | BAR | 20 | BAR | 50 |

TABLE 3-continued

| PAY TABLE | | | | | JACKPOT |
|---|---|---|---|---|---|
| Best of 3 or 4 Cards | | | Pays to 1 | | DRAW! |
| ANY ORDER "7" | "7" | JOKER | 50 | "7" | 400 |
| SEQUENTIAL "7" | "7" | "7" | 100 | JOKER | 2000 |

Any suitable pay table can be used depending on the possible winning combinations, the number of cards in the deck, the number of symbols used, the distribution of the symbols throughout the deck of cards and the percentage of the amounts wagered which is mathematically desired to be retained by the gaming establishment. The payout amounts shown in Table 3 can be increased or decreased as desired based on the mathematics of the game and the desired theoretical percentages for player and the house.

Following are a few examples showing how the method of play of this alternative version of the present invention would proceed.

Example #4: The player makes an initial BET wager of $10. The player is dealt one Orange, one Cherry and one Bell. Since the player has a winning combination on the first three cards, the player proceeds to the draw step of the method of play. The player then receives a fourth card with no additional wager required. The player will win based on the best winning combination that is formed by the player's four cards. In this example, the best hand that the player could make would be if the fourth card were another Cherry or a Wild Joker symbol. The player would then have Two Cherries and would be paid 2 to 1 odds on his $10 BET wager which results in the player receiving $30 gross. If the player receives some other card as his fourth card, the player would have a best hand of 1 Cherry and the player would be paid ½ to 1 odds on his $10 BET wager which results in the player receiving $15 gross.

Example #5: The player makes an initial BET wager of $10. The player is dealt one Melon, one Orange and one Bell. This hand is not a winning combination and has little chance to improve with the DRAW option. However, if the player desires to take the DRAW option and makes the additional $10 DRAW wager, the best the player could hope to attain on the fourth card is a Cherry or a Wild Joker symbol. If the player receives a Cherry or a Wild Joker symbol as his fourth card, the player would have a hand containing one Cherry which is a winning combination. The player would receive an odds payout based on the amount of the DRAW wager and the BET wager is a "push" since the fourth card improved the hand to a winning combination. The player would be paid ½ to 1 odds on his $10 DRAW wager which results in the player receiving $25 gross, or only a $5 net win. If the player does not improve his hand to a winning combination with the fourth card, then the player loses both the DRAW wager and the BET wager.

A player should be discouraged from making a "DRAW" wager when the player's first three cards do not contain at least a pair. As a result, generally a player should have a "pair" to make a DRAW wager.

Example #6: The player makes an initial BET wager of $10. The player is dealt two Bells and one Wild Joker symbol. Since these cards are a winning three-of-a-kind combination, the dealer proceeds to the draw step of the method of play. The player then receives a fourth card for no extra wager or cost and the player will win based on the best winning combination that is formed by the player's four cards. In this example, the best hand that the player could make would be if the fourth card were another Bell. The player would have four Bells and would be paid 15 to 1 odds on his $10 BET wager which results in the player receiving $160 gross. If the player receives some other card as his fourth card, the player would still have a three Bells hand and the player would be paid 6 to 1 odds on his $10 BET wager which results in the player receiving $70 gross.

Example #7: The player makes an initial BET wager of $10. The player is dealt two Bars and one Cherry, which is a winning combination in the first three cards and therefore entitles the player to a free DRAW card. The player then proceeds to the draw step of the method of play. The player will receive a fourth card and the player wins based on the best winning combination that is formed by the player's four cards. In this example, the best hand that the player could make would be if the fourth card were a Bar or Wild Joker symbol. The player would then have three Bars and would be paid 20 to 1 odds on his $10 BET wager for $210 gross. If the player receives a Cherry as his fourth card, the player would have a hand containing two Cherries and the player would be paid 2 to 1 odds on his $10 BET wager which results in the player receiving $30 gross. If the player receives some other card as the fourth card in this DRAW step, he would still have one Cherry and be paid ½ to 1 odds on his $10 BET wager which results in the player receiving $15 gross.

Example #8: The player wagers $5. He is dealt Cherry-Joker-7, which qualifies for 2 to 1 payoff (two Cherries). This hand being an initial BET wager winning combination, the player receives a free DRAW card. If, for example, the DRAW card is an Orange, the hand remains a winner because it contains two Cherries (one Cherry and one Wild Joker). The player is paid $10 next to his $5 BET wager. Therefore the gross wager was $5, but the gross return was $15.

Example #9: The player wagers $5. He is dealt Bar-Bar-7, which is not a winning combination but can possibly be improved by the DRAW option. The player elects to DRAW so he makes the DRAW wager by putting up another $5 wager. If the DRAW card is another Bar, the player's hand is improved to a three Bar winner. The player is paid 20 to 1 on the player's DRAW wager and, since the player improved his hand to a winning hand on the fourth card, his BET wager is left in place essentially being a "push", with $100 win paid on the DRAW wager only. Therefore the gross wager was $10 ($5 BET, $5 DRAW) and the gross return was $110 ($5 BET "push", 20 to 1 odds on $5 DRAW). If the player had not improved his hand to a winning combination with the fourth card, the player would have lost both this BET wager and his DRAW wager.

Example #10: The player wagers $5. He is dealt Bell-Orange-Joker. Again because the Joker is always wild, the hand is at the very least a Bell-Orange-Cherry, which is a BET winner. The player receives a free DRAW card. This hand combination, since it contains a Wild Symbol, may also be a pair of Oranges or Bells. If, for example, the DRAW card were an Orange, the player's hand would be improved to a three Orange winner. The player is then paid 3 to 1 on the BET wager. The gross wager was $5 and the gross win return was $20.

Example #11: The player wagers $5. He is dealt a Melon-Melon-Melon. This is a three-of-a-kind winner. This is a BET winner which qualifies the player for a free DRAW card. The player is dealt a fourth DRAW card. If the DRAW card is another Melon or Wild Joker, the player is paid the four-of-a-kind jackpot odds of 12 to 1. If the DRAW card fails to improve the hand the player still receives the 5 to 1 odds for the natural three-of-a-kind he originally had.

Example #12: The player wagers $5. He is dealt Grape-Grape-Bar. This hand is not a winning combination on the BET wager; however, the player may draw a fourth card to try to improve his hand to a pay table winner. The preferred DRAW card is a Grape which makes this hand a 4 to 1 winner and his BET is left in place or "pushed", for a net win of $20 in this example, since the player improved his hand to a winning hand on the fourth card. If the DRAW card is a Cherry, the player will win ½ to 1 on his DRAW wager and his BET is left in place or "pushed", for a net win of $2.50 in this example, since the player improved his hand to a winning hand on the fourth card. If the player had not improved his hand to a winning combination with the fourth card, the player would have lost both this BET wager and his DRAW wager.

While the invention has been illustrated with respect to several specific embodiments thereof, these embodiments should be considered as illustrative rather than limiting. Various modifications and additions may be made and will be apparent to those skilled in the art.

What is claimed is:

1. A method of playing a card game in which various card combinations are predetermined as winning card combinations and a pay table is provided with payout amounts being associated with each predetermined winning combination comprising:

a) providing a deck of playing cards consisting essentially of 53 cards having symbols selected from the group consisting of 7's, Bars, Bells, Grapes, Oranges, Melons, Cherries and at least one Joker;

b) a player making a first wager to participate in the game;

c) dealing three cards from the deck to the player d) the player achieving a winning combination if the player's first three cards comprise a card combination from the group consisting of three matching symbols, one Cherry, two Cherries and a Joker;

e) if the player's first three cards comprise a winning combination, dealing to the player a fourth card with no additional wager required;

f) awarding the player a payout amount based on the amount of the player's first wager based on the predetermined winning combination achieved by the player from the four cards;

g) if the player's first three cards contain a non-winning pair combination, offering the player an option to make a second wager and receive a fourth card;

h) awarding the player a payout amount based on the amount of the player's second wager if the player achieves a predetermined winning combination from the four cards and returning the amount of the first wager to the player; and i) if the player does not achieve a winning combination, the player losing the first wager and the second wager, if made.

2. The method of claim 1 in which the fifty-three card deck consists of three 7's, five Bars, eight Bells, ten Grapes, twelve Oranges, nine Melons, five Cherries and one Wild Joker.

3. The method of claim 1 in which the second wager is of equal value to the first wager.

4. The method of claim 1 in which the pay table comprises:

| PAY TABLE | | | | | JACKPOT |
|---|---|---|---|---|---|
| Best of 3 or 4 Cards | | | Pays to 1 | | DRAW! |
| CHERRY | **** | **** | ½ | | |
| CHERRY | CHERRY | **** | 2 | 4th card | 4 of a Kind |
| ORANGE | ORANGE | ORANGE | 3 | ORANGE | 7 |
| GRAPE | GRAPE | GRAPE | 4 | GRAPE | 10 |
| MELON | MELON | MELON | 5 | MELON | 12 |
| BELL | BELL | BELL | 6 | BELL | 15 |
| CHERRY | CHERRY | CHERRY | 7 | CHERRY | 25 |
| BAR | BAR | BAR | 20 | BAR | 50 |
| ANY ORDER "7" | "7" | JOKER | 50 | "7" | 400 |
| SEQUENTIAL "7" | "7" | "7" | 100 | JOKER | 2000. |

5. A method of playing a card game in which various card combinations are predetermined as winning card combinations and a pay table is provided with payout amounts being associated with each predetermined winning combination comprising:

a) providing a deck of playing cards;

b) a player making a first wager to participate in the game;

c) dealing three cards from the deck to the player d) if the player's first three cards comprise a winning combination, dealing to the player a fourth card with no additional wager required;

e) awarding the player a payout amount based on the amount of the player's first wager based on the predetermined winning combination achieved by the player from the four cards;

f) if the player's first three cards contain a non-winning pair combination, offering the player an option to make a second wager and receive a fourth card;

g) awarding the player a payout amount based on the amount of the player's second wager if the player achieves a predetermined winning combination from the four cards and returning the amount of the first wager to the player; and h) if the player does not achieve a winning combination, the player losing the first wager and the second wager, if made.

6. The method of claim 5 in which the second wager is of equal value to the first wager.

7. The method of claim 5 in which the pay table comprises:

| PAY TABLE | | | | | JACKPOT |
|---|---|---|---|---|---|
| Best of 3 or 4 Cards | | | Pays to 1 | | DRAW! |
| CHERRY | **** | **** | ½ | | |
| CHERRY | CHERRY | **** | 2 | 4th card | 4 of a Kind |
| ORANGE | ORANGE | ORANGE | 3 | ORANGE | 7 |
| GRAPE | GRAPE | GRAPE | 4 | GRAPE | 10 |
| MELON | MELON | MELON | 5 | MELON | 12 |
| BELL | BELL | BELL | 6 | BELL | 15 |
| CHERRY | CHERRY | CHERRY | 7 | CHERRY | 25 |
| BAR | BAR | BAR | 20 | BAR | 50 |
| ANY ORDER "7" | "7" | JOKER | 50 | "7" | 400 |
| SEQUENTIAL "7" | "7" | "7" | 100 | JOKER | 2000. |

* * * * *